US005862925A

United States Patent [19]

Grzywinski

[11] Patent Number: 5,862,925

[45] Date of Patent: Jan. 26, 1999

[54] HANGING PLANT TRACK SYSTEM

[76] Inventor: David Grzywinski, 9277 Dartford Rd., Woodbury, Minn. 55125

[21] Appl. No.: 731,453

[22] Filed: Oct. 15, 1996

[51] Int. Cl.[6] ..... A47F 5/00

[52] U.S. Cl. ..... 211/162; 211/113; 211/115; 248/323

[58] Field of Search ..... 211/162, 94.01, 211/113, 115; 248/323, 324, 328, 317, 223.41

[56] References Cited

U.S. PATENT DOCUMENTS

| | | | |
|---|---|---|---|
| D. 257,398 | 10/1980 | Tedesco | D26/85 |
| 3,875,866 | 4/1975 | Mazuyer | 104/107 |
| 3,944,180 | 3/1976 | Rogers | 248/323 |
| 4,004,770 | 1/1977 | Karass | 248/323 |
| 4,037,098 | 7/1977 | Kowalski | 248/323 X |
| 4,116,134 | 9/1978 | Troth | 104/111 |
| 4,170,843 | 10/1979 | Talwani | 47/39 |
| 4,497,525 | 2/1985 | Mittelmann | 211/113 X |
| 4,592,527 | 6/1986 | Karapita | 211/113 X |
| 4,635,558 | 1/1987 | Hoehn | 104/111 |
| 4,694,531 | 9/1987 | Foy | 16/87 |
| 5,165,647 | 11/1992 | Ribeiro | 248/323 |
| 5,390,443 | 2/1995 | Emalfarb | 47/67 |
| 5,409,191 | 4/1995 | Wenmaekers | 248/317 |
| 5,429,252 | 7/1995 | Liu | 211/94.01 |
| 5,478,039 | 12/1995 | Wright | 248/341 |

*Primary Examiner*—Robert W. Gibson, Jr.
*Attorney, Agent, or Firm*—Merchant, Gould, Smith, Edell, Welter & Schmidt, P.A.

[57] ABSTRACT

The present invention relates to a hanging plant track system (10) which comprises a track (12) securely fastenable by at least one track fastener (12A) to a bottom of a horizontal surface. The track (12) comprises a left track (12L) having a left track horizontal member (12LA) longitudinally disposed thereon. The track (12) further comprises a right track (12R) securely fastened longitudinally along abutting edges to the left track (12L) by a middle track (12M). The right track (12R) comprises a right track horizontal member (12RA) longitudinally disposed thereon.

The hanging plant track system (10)further comprises at least one carriage (14) slidably mounted within the track (12). The at least one carriage (14) comprises a left carriage (14L) having a left carriage horizontal member slot (14LA) longitudinally disposed therein. The left carriage horizontal member slot (14LA) is complimentary in configuration to the left track horizontal member (12LA). The left track horizontal member (12LA) is slidably mounted within the left carriage horizontal member slot (14LA). The at least one carriage (14) further comprises a right carriage (14R) having a right carriage horizontal member slot (14RA) longitudinally disposed therein. The right carriage horizontal member slot (14RA) is complimentary in configuration to the right track horizontal member (12RA). The right track horizontal member (12RA) is slidably mounted within the right carriage horizontal member slot (14RA). The at least one carriage (14) further comprises a carriage top (14MA) which is slidably positioned adjacent an under surface of the middle track (12M). The at least one carriage (14) further comprises carriage bottom (14MB) having a carriage bottom horizontal chamber (14MBB) connected to a carriage bottom vertical chamber (14MBA) therein. The carriage bottom vertical chamber (14MBA) is fluted functioning to allow a plant holder (18) which comprises a plant holder pot (18B) attached to the plant holder hook (18A) to move omnidirectional, the plant holder pot (18B) contains a plant (20). The hanging plant track system (10) further comprises a holder (16) is securely mounted within the at least one carriage (14). The holder (16) comprises a holder loop (16A) which is connected at a top distal end to a bottom distal end of a holder vertical member (16C) which is connected at a top distal end to a holder horizontal member (16B). The holder vertical member (16C) is movably mounted within the carriage bottom vertical chamber (14MBA). The holder horizontal member (16B) is securely fastened within the carriage bottom horizontal chamber (14MBB). The holder loop (16A) having a sufficient size opening to accept a plant holder hook (18A) therein.

21 Claims, 3 Drawing Sheets

HANGING PLANT TRACK SYSTEM

BACKGROUND OF THE INVENTION

1. Field of the Invention

The present invention relates to a hanging plant track system. More particularly, the present invention relates to a hanging plant track system which comprises a track having a carriage slidably mounted therein. The carriage comprises a holder rotatably mounted therein. The holder functions to accept a plant holder hook.

2. Description of the Prior Art

Plant hangers are well known in the art. They comprise configurations ranging from stationary rotatable mounts to roller track systems. However, the prior art lacks a hanging plant track system which is slidable along a track and omni-directionally rotatable therein.

Numerous innovations for hanging plant track system have been provided in the prior art that are described as follows. Even though these innovations may be suitable for the specific individual purposes to which they address, they differ from the present invention as hereinafter contrasted.

In U.S. Pat. No. 5,478,039, titled Swivel Hanging Apparatus, invented by W. Michael Wright, an overhead swivel hanging apparatus consisting of a mount (10) and a support (30), i.e. a grab. When assembled the apparatus is utilized to hang pendant objects, such as a plant or a bird cage, from a ceiling or the like. The mount is comprised of a base (12), a cross brace (14), a connective means (16), an ornamental shell (18), a pendant leg (20), and a spherical bearing (22) cast as a single piece. The support, mill stamped from tensile steel as a single piece, is an C-shaped hook with a widened U shaped grab (34) on the inferior aspect. On the superior aspect of the support is a slot (28) with a flange (24) which narrows posterior into keeper tabs(26). The keeper tabs are narrower than said slot which is wider than said leg. The internal surface has a concavity (32) bisected by the slot which facilitates a ball and socket integration with the bearing. To connect the support to the mount place the flanged end against the pendant leg and move it laterally until past the keeper tabs, thus preventing accidental uncoupling. The grab has a larger internal dimension at the top than at the bottom. Placement of the pendant object into the grab locks it into place through weight, friction, and interlocking torsion between the two pieces. Such an arrangement of components increases the rotational co-efficiency by means of a ball and socket integration and the interlocking torsion on the grab.

The patented invention differs from the present invention because the patented invention has a single non-adjustable attachment point for a hanging means. In the present invention, the carrying means may be slid by a user to a position anywhere along the length of a channel. The carrying means is securely attached to a hanging means.

In U.S. Pat. No. 5,390,443, titled Railing hanger, invented by Seymour Emalfarb and Bradley S. Emalfarb, a railing hanger is provided for hanging a plant from a deck rail. The railing hanger has a pair of substantially parallel planar brackets each including a pair of integral oppositely opening hooks. An upwardly opening hook on one bracket is joined with an upwardly opening hook on the other bracket by a plurality of transverse U-shaped stiffeners. The brackets and the stiffeners collectively define an upwardly opening container for receiving a plant. A downwardly opening hook on each bracket is selectively self connecting to the top of the railing and resists movement of the container laterally away from the rail. In an installed position, the container is spaced laterally from the railing and the bottom wall of the container is substantially horizontal. A rearwardly extending leg on the railing hanger prohibits movement of the container toward the rail.

The patented invention differs from the present invention because the patented invention is adapted to support a container from a railing in a cantilevered fashion. The patented invention does not hang from a ceiling. The present invention is adapted to hang from a ceiling and has an adjustable carrying means which may be slid within a channel.

In U.S. Pat. No. 4,694,531, Titled Suspended Overhead Hollow Track Support System, invented by Peter S. Foy, a coupler for structurally joining opposing ends of overhead support rails is disclosed herein having a pair of elongated splice plates carried on opposite sides of the rail ends so as to overlap the abutment of the ends. Each splice plate of the pair is of substantially uniform cross section having a U-shaped channel section including a central, upright web terminating in transverse, parallel flanges. The upper flange is integrally formed with an upwardly extending flange parallel to but spaced apart from the upright web. Trapezoidal ribs extend externally of the channel section in parallel space relationship along the upper flange immediately adjacent to the web and along the web midway between the transverse flanges. Threaded bores provided in the ribs insertably receive fasteners for bearing against the respective rails. The configuration of each splice plate is conformal with the external configuration of the overhead support rails.

The patented invention differs from the present invention because the patented invention is a device to join the proximal ends of two rails. It is not a hanging device. The patented invention does not have a carrying means which fastens to a hanging means as does the present invention. The patented invention is not directly mounted or supported from an overhead, but must attach to an adapter In U.S. Pat. No. 4,635,558, titled Long Span Conveyor Track and Hanger, invented by Robert A. Hoehn, a reinforced track section for a power and free conveyor system utilizes a conventional power rail with a free trolley track suspended therefrom. A uniform rail cap is superiorly attached to the power rail so as to provide a continuous, uninterrupted reinforcement thereto. The rail cap includes a continuous mounting flange in cooperation with hanger clamps which suspend the rail cap and underlying power and free tracks from overhead support structure at user-selectable points along the flange.

The patented invention differs from the present invention because the patented invention comprises a hanger system for supporting a channel or rail. The hanger system consists of a first rail having cutouts to permit engagement of a hanger adapter to fasten to a second channel or rail suspended beneath the hanger. The first rail is suspended from an overhead by plurality of rods. The present invention is fastened directly to an overhead through fasteners passed through mounting holes. The carrying means of your invention slides within the channel. The hanging means is held within the carrying means and constrained to rotate but not swing.

In Patent No D257,398, titled Overhead Track Light, invented by John A. Tedesco, the ornamental design for an overhead track light, is as shown.

The patented invention differs from the present invention because the patented invention is an ornamental design for a track light which has no significant features similar to the present invention.

In U.S. Pat. No. 4,170,843, titled Rotatable Hanging Planter Mount, invented by Muhammad Y. Talwani, the plant-mobile is a rotating plant hanger which includes a rotatable frame adapted to support a number of hanging plants. Embodiments of the plant-mobile are adapted to be mounted either from a wall or a ceiling, and the plantmobile includes an associated ceiling or wall mounting means. The rotatable frame includes round balls or hooks from which potted plants may be hung. In addition, the rotatable frame includes radial members which may be used to support the shoots of climbing plants or vines.

The patented invention differs from the present invention because the patented invention is adapted to fasten to a wall or overhead support objects suspended or hung from the patented invention may be rotated by hand or by a motor. The present invention fastens to a horizontal surface and comprises a carrying means which may be slid horizontally along the length of a track. The present invention further consists of a hanging means which supports objects. The objects suspended by the present invention may be rotated in addition to being slid horizontally.

In U.S. Pat. No. 4,116,134, titled Hangers for Overhead Suspended Track, invented by Paul H. Troth, an overhead suspended monorail type material handling system or apparatus comprising a rail having a web and a transversely extending flange on each side along its upper edge and a wider flange on each side along its lower edge, a plate-like member or cleat for attachment to an overhead structure and provided with a through aperture enlarged at one end, a bolt-like load supporting stud shaft or hanger member having a head at one end and a nut at the other end with the nut located in the enlarged part of the aperture through the cleat and the shank of the bold-like hanger member extending to the other side of the cleat member, and a pair of clamp plates bolted together, the clamp plates providing an inverted T-like aperture therebetween enclosing the head of the bolt-like hanger member and the narrower flanges on a part of the rail. As an alternative construction the headed stud or hanger member may be incorporated into the cleat.

The patented invention differs from the present invention because the patented invention is a support by a overhead 'T' track which carries a trolley. The 'T' is dissimilar from the present invention in that your invention is a channel. The present invention fastens directly to an overhead whereas the patented invention is fastened to an overhead and then supports a 'T' track.

In U.S. Pat. No. 3,875,866, titled Overhead Track Assembly, invented by Jean Ennenmond Mazuyer, an overhead track assembly forming an aerial runway for transporting goods, such as meat, has a pair of downwardly open channels constitute support rails which are hung on yoke like hanger brackets from an overhead support. One leg of each rail is received in a groove in each bracket and a setscrew is tightened in the bracket to clamp this leg in place. The other leg of each rails define with the facing rail a gap down through which extends the hanger arm of a trolley whose rollers each ride on one of the rails. These other legs may be cambered so as to permit lateral displacement of the hanger arm and this hanger arm has at least one roller engageable with the other legs to insure ease of riding. The rails are formed of a plurality of in-line rail sections whose ends are secured together by connecting pieces between the legs. One of the legs is formed with an inwardly directed ridge and the connecting piece is formed to snugly engage in the space between the two legs of the rail and be clamped in place with a setscrew.

The patented invention differs from the present invention because the patented invention is a device to support a downwardly open channels from an overhead. The present invention is a downwardly open channel fastened directly to a horizontal surface in which a carrying means slides.

Numerous innovations for a hanging plant track system have been provided in the prior art that are adapted to be used. Even though these innovations may be suitable for the specific individual purposes to which they address, they would not be suitable for the purposes of the present invention as heretofore described.

SUMMARY OF THE INVENTION

The present invention relates to a hanging plant track system. More particularly, the present invention relates to a hanging plant track system which comprises a track having a carriage slidably mounted therein. The carriage comprises a holder rotatably mounted therein. The holder functions to accept a plant holder hook.

The types of problems encountered in the prior art are plant hanging systems lack omni-directional rotatability with slidability.

In the prior art, unsuccessful attempts to solve this problem were attempted namely: omni-directional rotatable in a stationary mount or non-omni-directional rotatable in a roller track system. However, the problem was solved by the present invention because the carriage is slidably mounted within the track. The carriage has a holder rotatably mounted therein.

Innovations within the prior art are rapidly being exploited in the field of functional plant hanging systems.

The present invention went contrary to the teaching of the art which teaches omni-directional rotatable in a stationary mount or non-omni-directional rotatable in a roller track system.

The present invention solved a long felt need for a slidable omni-directional plant hanging system.

The present invention produced unexpected results namely: by manufacturing the carriage from a rubber or rubber composite material, frictional engagement occurs between the carriage and the track such that when the track is mounted on an angled surface, the carriage automatically locks into place without the requirement of additional mechanisms.

Accordingly, it is an object of the present invention to provide a hanging plant track system which comprises a track having a carriage slidably mounted therein.

More particularly, it is an object of the present invention to provide the carriage comprises a holder rotatably mounted therein.

In keeping with these objects, and with others which will become apparent hereinafter, one feature of the present invention resides, briefly stated, in the track which comprises a left track connected to a right track by a track middle.

When the left track is designed in accordance with the present invention, it comprises a left track horizontal member securely fastened along a longitudinal edge to a left track horizontal member lip.

In accordance with another feature of the present invention, the right track comprises a right track horizontal member securely fastened along a longitudinal edge to a right track horizontal member lip.

Another feature of the present invention is that the track is attachable to a surface by a plurality of track fasteners.

Yet another feature of the present invention is that the track further comprises a track end cap removably fastenable thereto.

Still another feature of the present invention is that the carriage further comprises a left carriage, a right carriage, a carriage top, and a carriage bottom.

Yet still another feature of the present invention is that the left carriage comprises a left carriage horizontal member slot therein with a left carriage horizontal member lip slot disposed along an edge thereof Still yet another feature of the present invention is that the right carriage comprises a right carriage horizontal member slot therein with a right carriage horizontal member lip slot disposed along an edge thereof Another feature of the present invention is that the carriage bottom comprises a carriage bottom vertical chamber connected to a carriage bottom horizontal chamber.

Yet another feature of the present invention is that the holder further comprises a holder loop connected to a holder vertical member which is connected to a holder horizontal member wherein the holder loop has sufficient size to accept a plant holder hook therein.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWING

10 - hanging plant track system (10)
12 - track (12)
12A - track fastener (12A)
12B - track end cap (12B)
12L - left track (12L)
12LA - left track horizontal member (12LA)
12LAA - left track horizontal member lip (12LAA)
12R - right track (12R)
12RA - right track horizontal member (12RA)
12RAA - right track horizontal member lip (12RAA)
12M - middle track (12M)
14 - carriage (14)
14L - left carriage (14L)
14LA - left carriage horizontal member slot (14LA)
14LAA - left carriage horizontal member lip slot (14LAA)
14R - right carriage (14R)
14RA - right carriage horizontal member slot (14RA)
14RAA - right carriage horizontal member lip slot (14RAA)
14MA - carriage top (14MA)
14MB - carriage bottom (14MB)
14MBA - carriage bottom vertical chamber (14MBA)
14MBB - carriage bottom horizontal chamber (14MBB)
16 - holder (16)
16A - holder loop (16A)
16B - holder horizontal member (16B)
16C - holder vertical member (16C)
18 - plant holder (18)
18A - plant holder hook (18A)
18B - plant holder pot (18B)
20 - plant (20)

DESCRIPTION OF THE PREFERRED EMBODIMENT

Figure 1:
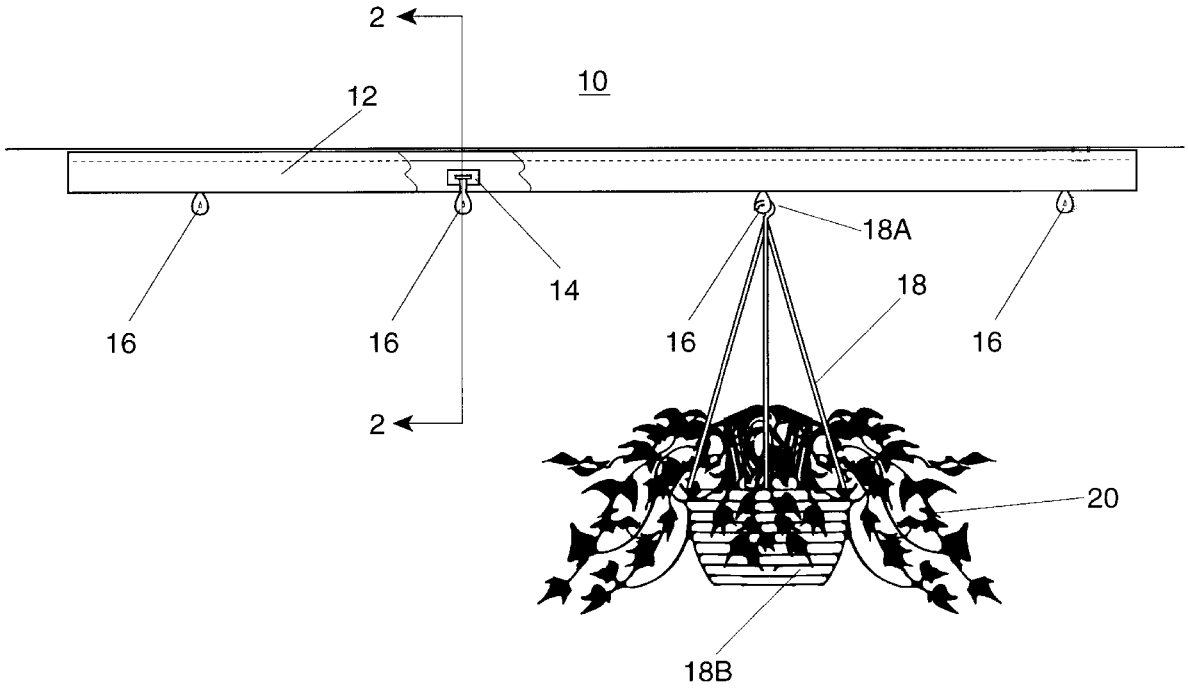
FIG. 1 is a side view of a hanging plant track system.

Referring to FIG. 1 which is a side view of a hanging plant track system (10) which comprises a track (12) securely fastenable by at least one track fastener (12A) to a bottom of a horizontal surface. The bottom of a horizontal surface is selected from a group consisting of roof, flat ceiling and angled ceiling. The track (12) comprises a left track (12L) having a left track horizontal member (12LA) longitudinally disposed thereon. The left track (12L) is preferably 1 ¼ inches in width. The track (12) further comprises a right track (12R) securely fastened longitudinally along abutting edges to the left track (12L) by a middle track (12M). The track middle (12M) is preferably 2 ¼ inches in width. The track middle (12M) is ⅛ inches thick functioning to rigidify the track (12). The right track (12R) comprises a right track horizontal member (12RA) longitudinally disposed thereon. The right track (12R) is 1 ¼ inches in width. The left track horizontal member (12LA) and the right track horizontal member (12RA) are preferably ⅛ inches in width.

The hanging plant track system (10)further comprises at least one carriage (14) is slidably mounted within the track (12). The at least one carriage (14) comprises a left carriage (14L) having a left carriage horizontal member slot (14LA) longitudinally disposed therein. The left carriage horizontal member slot (14LA) is complimentary in configuration to the left track horizontal member (12LA). The left track horizontal member (12LA) is slidably mounted within the left carriage horizontal member slot (14LA). The at least one carriage (14) further comprises a right carriage (14R) having a right carriage horizontal member slot (14RA) longitudinally disposed therein. The right carriage horizontal member slot (14RA) is complimentary in configuration to the right track horizontal member (12RA). The right track horizontal member (12RA) is slidably mounted within the right carriage horizontal member slot (14RA). The at least one carriage (14) further comprises a carriage top (14MA) which is slidably positioned adjacent an under surface of the middle track (12M). The at least one carriage (14) further comprises carriage bottom (14MB) having a carriage bottom horizontal chamber (14MBB) connected to a carriage bottom vertical chamber (14MBA) therein. The carriage bottom vertical chamber (14MBA) is fluted functioning to allow a plant holder (18) which comprises a plant holder pot (18B) attached to the plant holder hook (1 8A) to move omnidirectional, the plant holder pot (18B) contains a plant (20).

The hanging plant track system (10) further comprises a holder (16) is securely mounted within the at least one carriage (14). The holder (16) comprises a holder loop (16A) which is connected at a top distal end to a bottom distal end of a holder vertical member (16C) which is connected at a top distal end to a holder horizontal member (16B). The holder vertical member (16C) is movably mounted within the carriage bottom vertical chamber (14MBA). The holder horizontal member (16B) is securely fastened within the carriage bottom horizontal chamber (14MBB). The holder loop (16A) having a sufficient size opening to accept a plant holder hook (18A) therein. The track (12), the carriage (14), and the holder (16) are manufactured from a material selected from a group consisting of plastic, plastic composite, metal, metal alloy, epoxy, fiberglass, carbon-graphite, rubber, rubber composite and wood. The material is preferably paintable.

Figure 2:
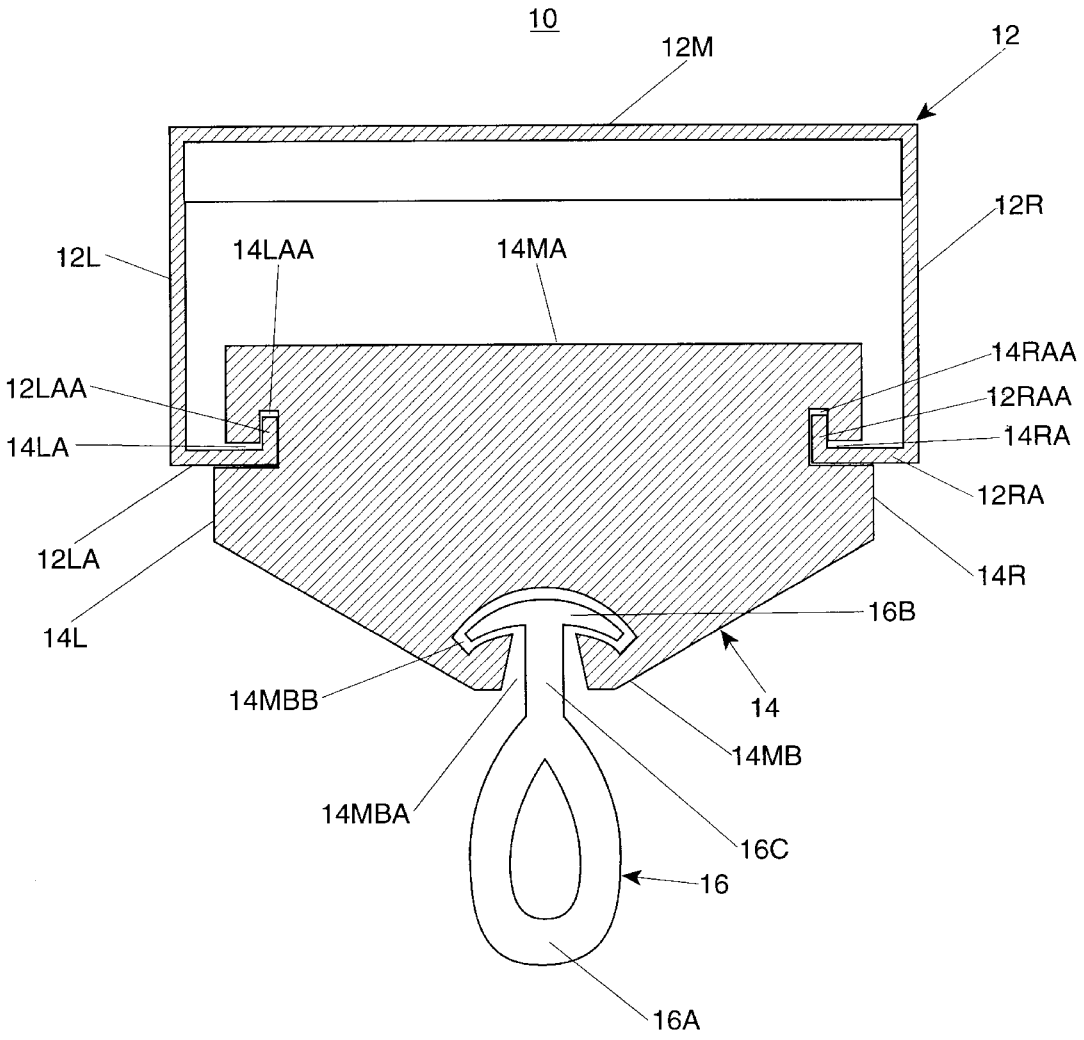
FIG. 2 is a cross sectional view of a hanging plant track system along line 2—2 of FIG. 1.
Figure 3A:
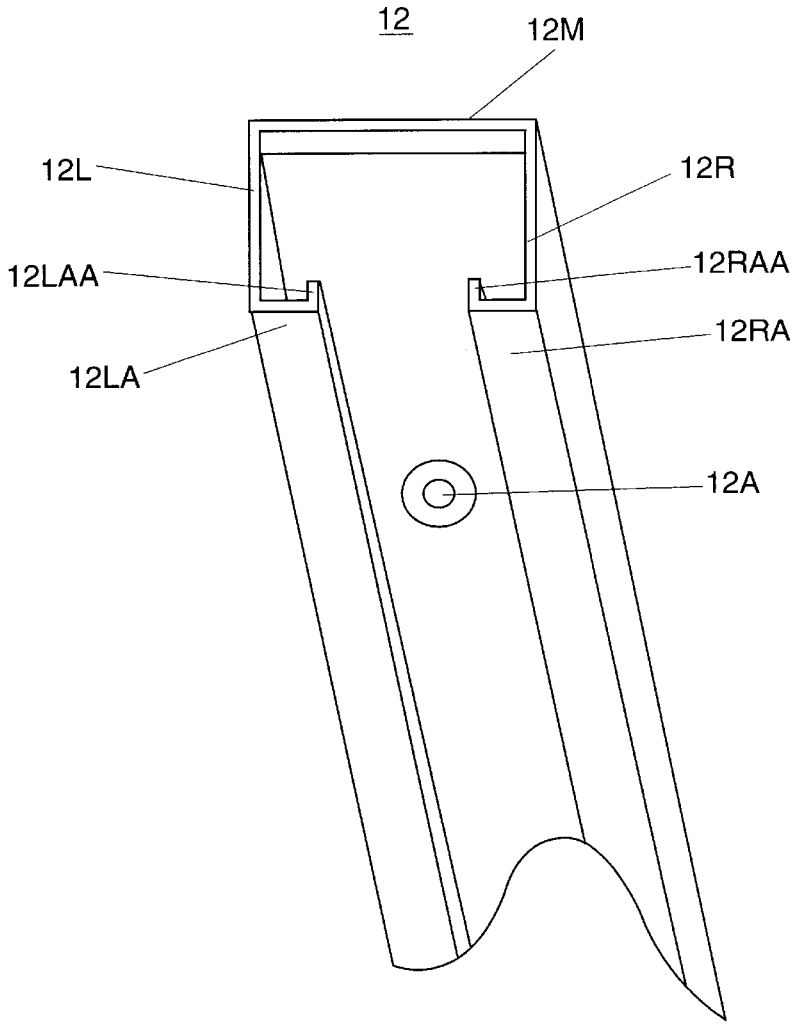
FIG. 3A is a bottom front perspective view of a track.

Referring to FIG. 2 which is a cross sectional view of a hanging plant track system (10) along line 2—2 of FIG. 1. Referring to FIG. 3A which is a bottom front perspective view of a track (12). The left track horizontal member (12LA) further comprises a left track horizontal member lip (12LAA) longitudinally disposed thereon. The left carriage horizontal member slot (14LA) further comprises a left carriage horizontal member lip slot (14LAA) longitudinally disposed therein. The left track horizontal member lip (12LAA) is complimentary in configuration to the left carriage horizontal member lip slot (14LAA). The left track horizontal member lip (12LAA) is slidably mounted within the left carriage horizontal member lip slot (14LAA). The right track horizontal member (12RA) further comprises a right track horizontal member lip (12RAA) longitudinally disposed thereon. The right carriage horizontal member slot (14RA) further comprises a right carriage horizontal member lip slot (14RAA) longitudinally disposed therein. The right track horizontal member lip (12RAA) is complimentary in configuration to the right carriage horizontal member lip slot (14RAA). The right track horizontal member lip (12RAA) is slidably mounted within the right carriage horizontal member lip slot (14RAA). The left track horizontal member lip (12LAA) and the right track horizontal member lip (12RAA) are 1/16 inches in width. The holder horizontal member (16B) is beveled functioning to permit rotation of the holder (16) within the carriage bottom horizontal chamber (14MBB).

Figure 3B:
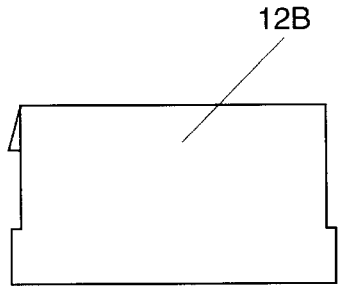
FIG. 3B is a front view of a track end cap.

Referring to FIG. 3B which is a front view of a track end cap (12B). The track (12) further comprises at least one track end cap (12B) removable insertable thereon. The track end cap (12B) functions to prevent the carriage (14) from exiting the track (12).

It will be understood that each of the elements described above, or two or more together, may also find a useful application in other types of constructions differing from the type described above.

While the invention has been illustrated and described as embodied in a hanging plant track system, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What Is claimed Is:

1. A hanging plant track system (10) comprising:

A) a track (12) securely fastenable by at least one track fastener (12A) to a bottom of a horizontal surface, the track (12) comprises a left track (12L) having a left track horizontal member (12LA) longitudinally disposed thereon, the track (12) further comprises a right track (12R) securely fastened longitudinally along abutting edges to the left track (12L) by a middle track (12M), the right track (12R) comprises a right track horizontal member (I 2RA) longitudinally disposed thereon;

B) at least one carriage (14) is slidably mounted within the track (12), the at least one carriage (14) comprises a left carriage (14L) having a left carriage horizontal member slot (14LA) longitudinally disposed therein, the left carriage horizontal member slot (14LA) is complimentary in configuration to the left track horizontal member (12LA), the left track horizontal member (12LA) is slidably mounted within the left carriage horizontal member slot (14LA), the at least one carriage (14) further comprises a right carriage (14R) having a right carriage horizontal member slot (14RA) longitudinally disposed therein, the right carriage horizontal member slot (14RA) is complimentary in configuration to the right track horizontal member (12RA), the right track horizontal member (12RA) is slidably mounted within the right carriage horizontal member slot (14RA), the at least one carriage (14) further comprises a carriage top (14MA) which is slidably positioned adjacent an under surface of the middle track (12M), the at least one carriage (14) further comprises carriage bottom (14MB) having a carriage bottom horizontal chamber (14MBB) connected to a carriage bottom vertical chamber (14MBA) therein;

C) a holder (16) is securely mounted within the at least one carriage (14), the holder (16) comprises a holder loop (16A) which is connected at a top distal end to a bottom distal end of a holder vertical member (16C) which is connected at a top distal end to a holder horizontal member (16B), the holder vertical member (16C), is movably mounted within the carriage bottom vertical chamber (14MBA), the holder horizontal member (16B) is securely fastened within the carriage bottom horizontal chamber (14MBB), the holder loop (16A) having a sufficient size opening to accept a plant holder hook (18A) therein;

wherein the carriage bottom vertical chamber (14MBA) is fluted functioning to allow a plant holder (18) which comprises a plant holder pot (18B) attached to the plant holder hook (18A) to move omni-directional, the plant holder pot (18B) contains a plant (20).

2. The hanging plant track system (10) as described in claim 1, wherein the left track horizontal member (12LA) further comprises a left track horizontal member lip (12LAA) longitudinally disposed thereon, the left carriage horizontal member slot (14LA) further comprises a left carriage horizontal member lip slot (14LAA) longitudinally disposed therein, the left track horizontal member lip (12LAA) is complimentary in configuration to the left carriage horizontal member lip slot (14LAA), the left track horizontal member lip (12LAA) is slidably mounted within the left carriage horizontal member lip slot (14LAA), the right track horizontal member (12RA) further comprises a right track horizontal member lip (12RAA) longitudinally disposed thereon, the right carriage horizontal member slot (14RA) further comprises a right carriage horizontal member lip slot (14RAA) longitudinally disposed therein, the right track horizontal member lip (12RAA) is complimentary in configuration to the right carriage horizontal member lip slot (14RAA), the right track horizontal member lip (12RAA) is slidably mounted within the right carriage horizontal member lip slot (14RAA).

3. The hanging plant track system (10) as described in claim 1, wherein the track (12) further comprises at least one track end cap (12B) removable insertable thereon.

4. The hanging plant track system (10) as described in claim 1, wherein the bottom of a horizontal surface is selected from a group consisting of roof, flat ceiling and angled ceiling.

5. The hanging plant track system (10) as described in claim 1, wherein the track middle (12M) is 2 1/4 inches in width.

6. The hanging plant track system (10) as described in claim 5, wherein the track middle (12M) is ⅛ inches thick functioning to rigidify the track (12).

7. The hanging plant track system (10) as described in claim 1, wherein the left track (12L) is 1 ¼ inches in width.

8. The hanging plant track system (10) as described in claim 1, wherein the right track (12R) is 1 ¼ inches in width.

9. The hanging plant track system (10) as described in claim 1, wherein the left track horizontal member (12LA) and the right track horizontal member (12RA) are ⅛ inches in width.

10. The hanging plant track system (10) as described in claim 1, wherein the left track horizontal member lip (12LAA) and the right track horizontal member lip (12RAA) are 1/16 inches in width.

11. A hanging plant track system (10) comprising:

A) a track (12) securely fastenable by at least one track fastener (12A) to a bottom of a horizontal surface, the track (12) comprises a left track (12L) having a left track horizontal member (12LA) longitudinally disposed thereon, the track (12) further comprises a right track (12R) securely fastened longitudinally along abutting edges to the left track (12L) by a middle track (12M), the right track 12R) comprises a right track horizontal member (12RA) longitudinally disposed thereon;

B) at least one carriage (14) is slidably mounted within the track (12), the at least one carriage (14) comprises a left carriage (14L) having a left carriage horizontal member slot (14LA) longitudinally disposed therein, the left carriage horizontal member slot (14LA) is complimentary in configuration to the left track horizontal member (12LA), the left track horizontal member (12LA) is slidably mounted within the left carriage horizontal member slot (14LA), the at least one carriage (14) further comprises a right carriage (14R) having a right carriage horizontal member slot (14RA) longitudinally disposed therein, the right carriage horizontal member slot (14RA) is complimentary in configuration to the right track horizontal member (12RA), the right track horizontal member (12RA) is slidably mounted within the right carriage horizontal member slot (14RA), the at least one carriage (14) further comprises a carriage top (14MA) which is slidably positioned adjacent an under surface of the middle track (12M), the at least one carriage (14) further comprises carriage bottom (14MB) having a carriage bottom horizontal chamber (14MBB) connected to a carriage bottom vertical chamber (14MBA) therein;

C) a holder (16) is securely mounted within the at least one carriage (14), the holder (16) comprises a holder loop (16A) which is connected at a top distal end to a bottom distal end of a holder vertical member (16C) which is connected at a top distal end to a holder horizontal member (16B), the holder vertical member (16C), is movably mounted within the carriage bottom vertical chamber (14MBA), the holder horizontal member (16B) is securely fastened within the carriage bottom horizontal chamber (14MBB), the holder loop (16A) having a sufficient size opening to accept a plant holder hook (18A) therein;

wherein the holder horizontal member (16B) is beveled functioning to permit rotation of the holder (16) within the carriage bottom horizontal chamber (14MBB).

12. The hanging plant track system (10) as described in claim 11, wherein the track (12), the carriage (14), and the holder (16) are manufactured from a material selected from a group consisting of plastic, plastic composite, metal, metal alloy, epoxy, fiberglass, carbon-graphite, rubber, rubber composite and wood.

13. The hanging plant track system (10) as described in claim 12, wherein the material is paintable.

14. A hanging plant track system comprising:

a longitudinal track including:

(i) a first track member having a first end;

(ii) a second track member having a first end and opposing the first track member;

(iii) a middle track member connected to the first ends of the first and second track members and maintaining the first and second track members in spaced apart relationship;

at least one carriage, slidable along the track, the carriage including:

(i) a carriage top surface facing towards the middle track member;

(ii) a carriage bottom surface facing away from the middle track; and a holder rotatably mounted to the at least one carriage, the holder comprising:

(i) a first end having an arrangement for accepting a plant hanger;

(ii) a second end mounted to the at least one carriage, the second end passing through the carriage bottom surface and not passing beyond the carriage top surface.

15. The hanging plant track system according to claim 14, wherein the first track member is parallel to the second track member and the middle track member is arranged perpendicular to the first and second track members.

16. The hanging plant track system according to claim 14, wherein the second end of the holder is beveled to permit rotation of the holder in the at least one carriage.

17. A hanging plant track system comprising:

a longitudinal track including:

(a) a first outer track member, the first outer track member having:

(i) a first end and a second end, the second end connected to a first inner track member, the first outer and first inner track members forming a first carriage track;

(b) a second outer track member opposite the first outer track member and having;

(i) a first end and a second end, the second end connected to a second inner track member, the second outer and second inner track members forming a second carriage track;

(c) a middle track member mounted to the first ends of the first and second outer track members for maintaining the first and second outer track members in a spaced apart relationship;

at least one carriage, slidable along the first and second carriage tracks;

a holder rotatably mounted to the at least one carriage, the holder comprising:

(i) a first end having an arrangement for accepting a plant hanger;

(ii) a second end directly mounted to the at least one carriage;

wherein the holder is a unitary structure.

18. The hanging plant track system according to claim 17, wherein the first outer track member is parallel to the second outer track member and the middle track member is arranged perpendicular to the first and second track members.

19. The hanging plant track system according to claim 17 wherein the first outer track member is parallel to the first inner track member and the second outer track member is parallel to the second inner track member.

20. The hanging plant track system according to claim 17 wherein the first outer track member and first inner track member are connected by a first intermediate member that is parallel to the middle track member and the second outer track member and second inner track member are connected by a second intermediate member that is parallel to the middle track member.

21. The hanging plant track system according to claim 17 wherein the carriage includes a first slot and a second slot, the first slot capable of interdigitating with the first inner track member and the second slot capable of interdigitating with the second inner track member.

* * * * *